United States Patent [19]

Aschauer et al.

[11] 4,411,148

[45] Oct. 25, 1983

[54] PRESS BRAKE

[75] Inventors: Hans Aschauer, Eferding; Günter Funk, Traun, both of Austria

[73] Assignee: Voest-Alpine Aktiengesellschaft, Linz, Austria

[21] Appl. No.: 247,226

[22] Filed: Mar. 25, 1981

[30] Foreign Application Priority Data

Apr. 24, 1980 [AT] Austria ..... 2203/80

[51] Int. Cl.[3] ..... B21D 5/04

[52] U.S. Cl. ..... 72/306; 72/319; 72/450

[58] Field of Search ..... 72/306, 319–322, 72/316, 450, 384, 387

[56] References Cited

U.S. PATENT DOCUMENTS

| | | | |
|---|---|---|---|
| 1,135,534 | 4/1915 | Kruse | 72/306 |
| 3,054,437 | 9/1962 | Laxo | 72/322 |
| 3,561,248 | 2/1971 | Bessho | 72/384 |
| 4,242,898 | 1/1981 | Salvagnini | 72/306 |

FOREIGN PATENT DOCUMENTS

| | | | |
|---|---|---|---|
| 1923675 | 4/1970 | Fed. Rep. of Germany . | |
| 2614177 | 10/1976 | Fed. Rep. of Germany . | |
| 2839978 | 3/1979 | Fed. Rep. of Germany . | |
| 2825591 | 5/1979 | Fed. Rep. of Germany . | |
| 1432302 | 2/1966 | France . | |
| 597567 | 8/1959 | Italy | 72/384 |
| 50-38076 | 12/1975 | Japan | 72/387 |
| 584575 | 1/1947 | United Kingdom . | |
| 958671 | 5/1964 | United Kingdom . | |
| 662199 | 5/1979 | U.S.S.R. | 72/321 |

*Primary Examiner*—Daniel C. Crane
*Attorney, Agent, or Firm*—Kurt Kelman

[57] ABSTRACT

A press brake comprises at least one driven bending tool, which is adapted to cooperate with a second bending tool. In order to provide a great latitude regarding the bending operations to be performed, the driven bending tool is driven by means of a four-bar linkage, which comprises two crank arms, which are rotatably mounted in a frame, and a link, which connects the crank arms and carries the driven bending tool. An adjusting drive is provided which is power-operable to displace the pivot connecting one of said crank arms to the frame or to change the length of one of said crank arms.

8 Claims, 6 Drawing Figures

PRESS BRAKE

BACKGROUND OF THE INVENTION (1) Field of the Invention

This invention relates to a press brake for bending sheet metal elements, comprising at least one driven bending tool which is adapted to cooperate with a second bending tool.

(2) Description of Prior Art

A known press brake of that type has been disclosed in German Early Disclosure No. 28 39 978 and comprises upper and lower bending tools, which are mounted on the mutually opposite flanges of a channel-section beam and can be vertically adjusted in unison with said beam relative to a second pair of bending tools, which serve also to hold the workpiece in position. Because the driven bending tools are moved along a straight line in that known press brake, relatively strong bending forces must be exerted therein. An additional disadvantage, which is more serious, resides in that only certain angles of bend can be obtained because the tool carrier is channel-shaped and is moved vertically. This restricts the range of shapes to which the workpiece can be bent. It may also be mentioned that the use of a common carrier for both driven bending tools will restrict the length in which the workpiece can be inserted between the bending tools and, as a result, the width of the flange which can be formed on the workpiece. This will also give rise to difficulties in the handling of the workpiece, e.g., by a manipulator.

SUMMARY OF THE INVENTION

It is an object of the invention to avoid these disadvantages and so to improve a press brake of the kind described first hereinbefore that the driven bending tool will be moved relative to the second bending tool in a manner which is desirable with a view to the desired shape of the workpiece so that the required bending forces will be minimized and there is a great latitude regarding the shapes to which the workpiece can be bent.

This object is accomplished in accordance with the invention in that the driven bending tool is adapted to be driven by means of a four-bar linkage, which comprises two crank arms, which are rotatably mounted in a frame, and a link which connects the crank arms and carries the driven bending tool, and an adjusting drive is provided, which is operable to displace the pivot connecting one of said crank arms to the frame or to change the length of one of said crank arms.

The adjusting drive for adjusting the pivot connecting one crank arm to the frame or for adjusting the length of one crank arm is provided in addition to the conventional drive for rotating one crank arm of the four-bar linkage and constitutes simple means which afford the decisive advantage that the conventional working movement imparted to the link and the driven bending tool by one crank arm can be combined by a movement which is effected by the other crank arm and substantially transverse to that conventional working movement so that the path of the driven bending tool can be selected to provide various angles of bend and bend radii. As a result, the driven bending tool can be moved transversely to the longitudinal direction of the workpiece at any time so that the bending force can be applied in a desirable manner throughout the angle of bend. For this reason, relatively small bending forces will be sufficient. Besides, the follow-up movement imparted to the driven bending tool in accordance with the angle of bend which has already been achieved permits a bending through angles greatly in excess of 90°. For this reason, sheet metal elements can be bent within a large range particularly because there is no restriction regarding the length to which the workpiece can be inserted between the driven bending tool and the second bending tool as the four-bar linkage for driving the driven bending tool need not protrude into the path of the workpiece. This is due to the fact that the crank arms of the four-bar linkage may be duplicated and provided on opposite sides of the path for the workpiece.

For most of the bending operations which may be desired, the driven bending tool is initially moved transversely to the surface of the sheet metal element which is to be bent to form a flange. Subsequently, the driven bending tool is moved along a path which relative to said surface has an inclination corresponding to the desired angle of bend. It will often be sufficient to divide the working stroke of the driven bending tool into two sections, which are designed to be favorable for initial and final bending steps, respectively. In accordance with a preferred further feature of the invention this can be accomplished in that the adjusting drive for displacing the pivot or for changing the length of one crank arm is operable in dependence on the angular position of the driven other crank arm, which is pivotally moved relative to the frame by the conventional rotary drive means, when said driven crank arm has reached the angular position at which the driven bending tool is to be diverted from the path section that is desirable for the initial bending step to the path section which provides optimum conditions for the final bending step, the adjusting drive is operated so that the original movement of the driven bending tool is combined with a transverse movement which results in a corresponding change of the direction of the path of the driven bending tool. That transverse movement may be effected by an increase of the length of one crank arm or in that the pivot connecting that crank arm to the frame is displaced transversely to the direction of movement of the link.

It will readily be appreciated that a driven bending tool which is moved along a path consisting of two sections cannot be used to achieve relatively large angles of bend under the same favorable conditions. In that case it will not be sufficient to provide a path section for an initial bending step and a path section for the final bending step but a path section for an intermediate bending step will also be required. In accordance with the invention such tripartite path for the movement of the driven bending tool can be obtained in that the crank arm which is connected to the frame by an adjustable pivot or which can be adjusted in length is adjusted by the adjusting drive when the other crank arm has been moved to a limiting position, which is defined by a stop. In that operation the four-bar linkage is driven only in a sense to impart a transverse movement to the driven bending tool so that the latter is actually moved during the final bending step along a path section which is transverse to the first path section. The intermediate path section is inclined at an intermediate angle. By a movement of the driven bending tool along these path sections the workpiece can be bent through angles greatly in excess of 90°.

The means for changing the length of one crank arm will be structurally simple if said crank arm consists of a fluid-operable actuator. Whereas other arrangements may be used, they are more expensive.

In order to permit a movement of the driven bending tool in a direction which is transverse to the path along which the tool is moved by the conventional movement of the link, the adjustable crank arm may be pivoted to an adjusting lever arm, which is pivoted to the frame. In that case, the adjustable pivot connecting said adjustable crank arm to the frame can be adjusted as desired by a suitable angular movement of said adjusting lever arm. In conjunction with an adjusting drive for adjusting the adjustable pivot in dependence on the angular position of the other crank arm, which is driven in conventional manner by rotary drive means, a further feature of the invention resides in that the adjusting lever arm carrying the adjustable pivot for the adjustable crank arm consists of one arm of a double-armed adjusting lever and the second arm of said lever cooperates with a control lever, which is operatively connected to the other crank arm. When the driven crank arm has performed a predetermined angular movement, the control lever driven by the driven crank arm engages said second arm of the adjusting lever and the latter until the control lever disengages the adjusting lever. These structurally simple means ensure that the driven bending tool will move along the path consisting of two sections, which include with each other an angle that depends on the lever ratios which have been selected.

If an additional section which is substantially transverse to the first path section is to be added to said tool path it will be sufficient to operate a fluid-operable actuator in order to adjust the adjusting lever arm which carries the adjustable pivot of the adjustable crank arm after the means for driving the other crank arm have been disabled, e.g., in response to the engagement with a stop. Such a fluid-operable actuator for adjusting the adjusting lever arm carrying the adjustable pivot obviously must not obstruct the movement imparted to the adjusting lever by the driven crank arm via the control lever. This requirement may be met, e.g., in that pressure fluid is released from the fluid-operable actuator. But this would require a relatively large stroke of the fluid-operable actuator and an undefined path for the adjustment because in that case the path along which the adjusting lever arm is adjusted would depend on the end position of the control lever connected to the driven crank arm. These disadvantages can be avoided in that the fluid-operable actuator for adjusting the adjusting lever arm is connected to a displaceable pivoted backing element, which is adapted to be fixed in a plurality of positions. When the adjusting lever has been driven by the control lever and the fluid-operable adjusting actuator is fixed in the position to which it has been moved, the adjusting lever arm carrying the adjustable pivot of the adjustable crank arm will be adjusted by the stroke length of the adjusting actuator. The displaceable pivoted backing element for the adjusting actuator may consist of a fluid-operable backing actuator, which is connected in series with the adjusting actuator. Pressure fluid is released from said backing actuator as long as the adjusting lever carrying the adjustable pivot of the adjustable crank arm is driven by means of the control lever. The backing actuator is subsequently held in position in that the supply and discharge of the pressure fluid to and from the backing actuator is blocked.

For some bending operations it would be desirable to control the path of the driven bending tool at any given time only by the conventional means for driving the four-bar linkage by means of its normally driven crank arm or only by the means for adjusting the four-bar linkage by an adjustment of a pivot connecting a crank arm to the frame. For this purpose it is necessary to permit an interruption of the operative connection between the control lever connected to the driven crank arm and the adjusting lever carrying the adjustable pivot. If the adjusting lever carrying the adjustable pivot for the adjustable crank arm and the control lever connected to the driven crank arm are operatively connected by a coupling element, which is adjustably connected to one of said levers, said coupling element can be adjusted to such a position that the control lever can be moved freely past the adjusting lever carrying the adjustable pivot so that the operative connection is interrupted as desired. A fluid-operable control actuator connected to the coupling element may be operated to adjust the latter. This measure permits a simple control of the coupling element and affords the additional advantage that the discharge of pressure fluid from the backing actuator can be controlled in dependence on the pressure applied to the fluid actuator connected to the coupling element. This is due to the fact that the load applied to the adjusting lever carrying the adjustable pivot ensures that when the adjusting lever carrying the adjustable pivot has been released the driven bending tool cannot be moved out of its predetermined path by the resilient restoring forces exerted by the workpiece as the adjusting lever carrying the adjustable pivot will not be released for a movement until the control lever is firmly urged against the adjusting lever.

It has not been explicitly stated hereinbefore and is believed to be readily appreciated that the adjusting lever carrying the adjustable pivot of the adjustable crank arm must be held in position when said lever is not driven. This is necessary to ensure that the driven bending tool will move along a predetermined path. The adjusting lever can desirably be held in position by means of the backing actuator, which is connected in series with the adjusting actuator for adjusting the adjusting lever. The latter can be held in position in that the supply and discharge conduits of said backing actuator are blocked. Other means may be used for this purpose because it is sufficient to lock the adjusting lever.

BRIEF DESCRIPTION OF THE DRAWING

An embodiment of the invention is shown by way of example in simplified view in the drawing, in which.

DESCRIPTION OF THE PREFERRED EMBODIMENT

Figure 1:
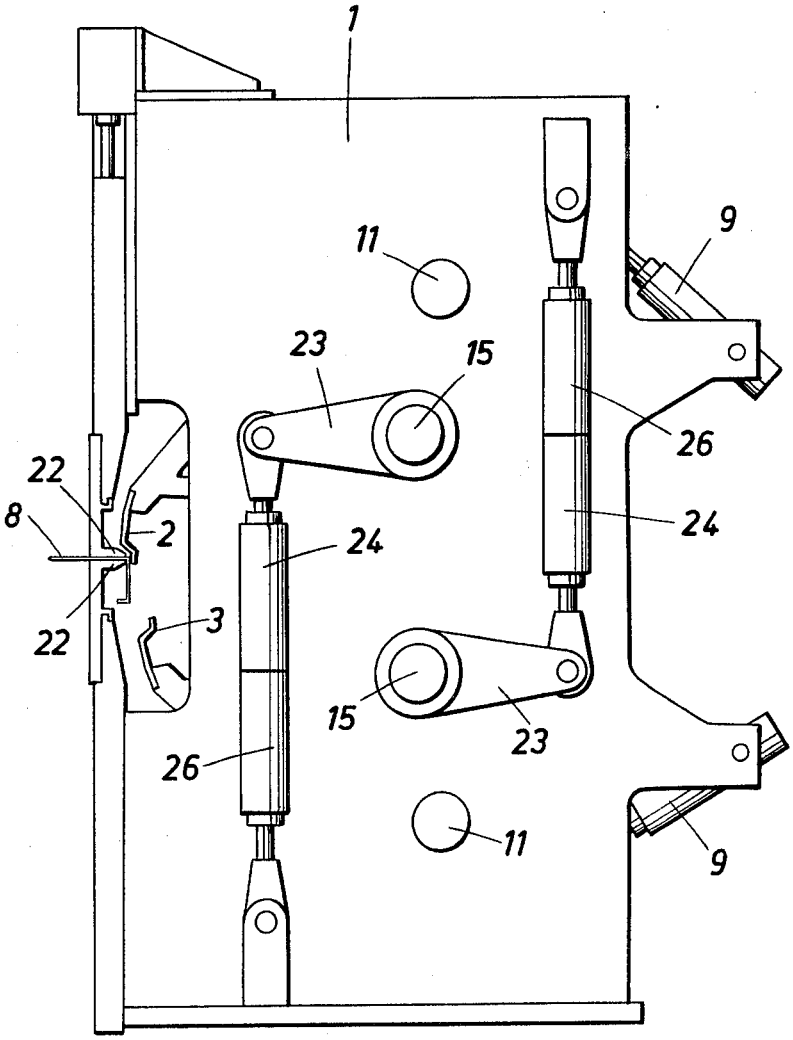
FIG. 1 is a side elevation showing a press brake embodying the invention.
Figure 2:
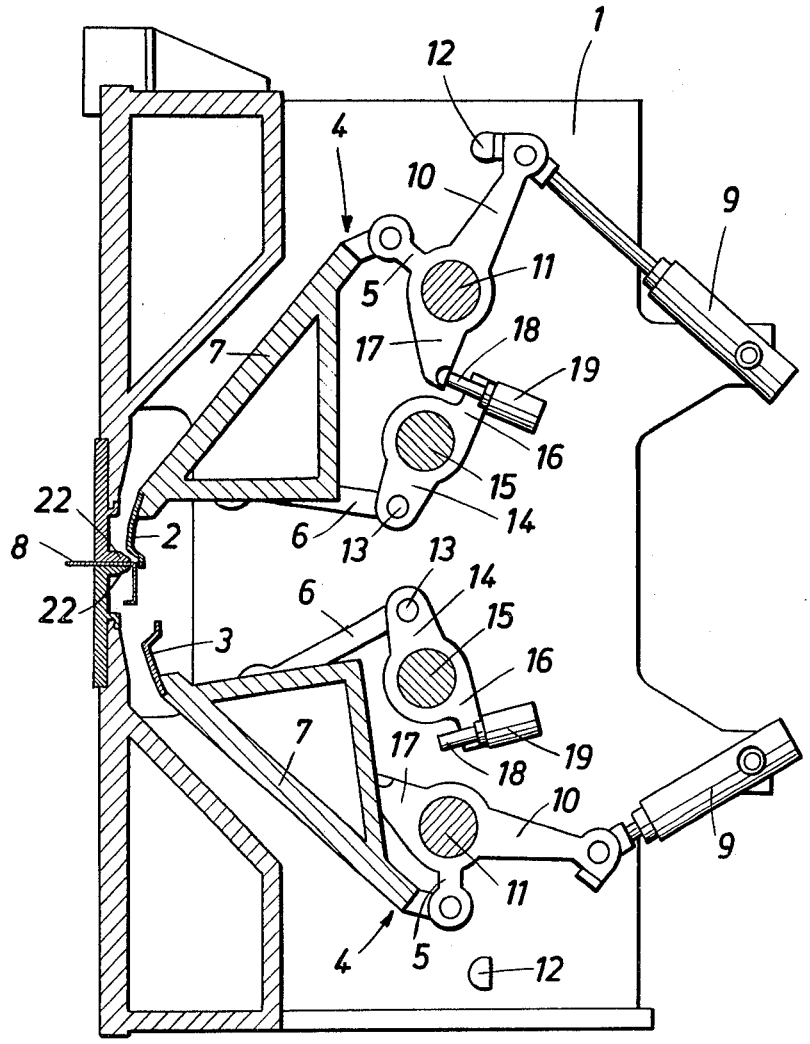
FIG. 2 is a sectional view showing that press brake.

As is particularly apparent from FIGS. 1 and 2, the press brake shown comprises a frame 1 having side walls in which the driven bending tools 2 and 3 are mounted by means of four-bar linkages 4. Each of said four-bar linkages 4 comprises two crank arms 5 and 6 and a link 7, which connects the crank arms 5 and 6. The link 7 consists of a box section and is disposed between the side walls of the frame 1 and carries the driven bending tool 2 or 3. Each of the crank arms 5 and 6 is duplicated and disposed on opposite sides of the path for the sheet metal element 8 to be processed so that the latter can pass freely between the links 7.

Each of the four-bar linkages 4 is adapted to be driven by a hydraulic actuator 9, which is pivoted at one end to the frame 1 and at the other end to a radial arm 10, which together with the crank arm 5 of the four-bar linkage 4 is pivotally movable about a pivot 11 until the radial arm 10 engages a stop 12 which is fixed to the frame. This position is shown in FIG. 2 with respect to the upper driven bending tool 2.

Figure 3:
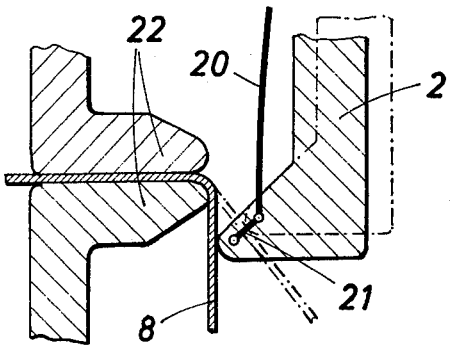
FIG. 3 illustrates on a larger scale the operation of a driven bending tool during the bending through angles up to 90°.

In addition to these drive means comprising the actuator 9, each four-bar linkage 4 is provided with an adjusting drive for adjusting an adjustable pivot 13 of the crank arm 6 relative to the frame 1. For this purpose the crank arm 6 is not pivoted directly to the frame 1 but to an adjusting lever arm 14, which is secured to a shaft 15, which is rotatably mounted in the frame 1. To facilitate the angular movement of the lever arm 14, the latter consists of one arm of a double-armed lever having a second arm 16. A control lever 17 connected to the crank arm 5 and the second lever arm 16 of the adjusting lever 14, 16 can be operatively connected by means of a coupling element 18, which is adjustably mounted on the second lever arm 16. When the coupling element 18 is moved by means of a fluid-operated control actuator 19 to its coupling position, the control lever 17 will engage the coupling element 18 when the crank arm 5 has performed a predetermined angular movement and the control lever 17 will subsequently impart to the adjusting lever 14, 16 an angular movement which will depend on the lever ratios which have been selected. It is apparent from FIG. 3 that the additional adjustment of the pivot 13 of the crank arm 6 will result in a change of the path of the driven bending tool 2. As long as the four-bar linkage 4 is driven only by means of the crank arm 5, the driven bending tool moves in unison with the link 7 along the path designated 20 in FIG. 3. As a result of the angular movement of the adjusting lever 14, 16, that movement of the driven bending tool in unison with the link 7 is combined with a transverse movement so that the driven bending tool 2 is moved from the position indicated in phantom in FIG. 4 to the position represented by solid lines. The path along which the driven bending tool 2 is thus moved is designated 21. It is apparent that the driven bending tool will move along the path 20 as long as the transverse movement is not imparted to the tool, and along the path 21 when the transverse movement is additionally imparted to the tool. During the movement of the tool 2 along the path 20, the sheet metal element 8 gripped between two jaws 22 is bent to the shape indicated in phantom. The movement of the tool 2 along the path 21 will result in a final bending of the sheet metal element 8. During these bending steps, the driven bending tool 2 cooperates with the bending tools constituted by the jaws 22 and the bending forces exerted by the driven bending tool 2 on the sheet metal element 8 will always act on the latter in a favorable manner so that relatively small bending forces will be sufficient.

Figure 4:
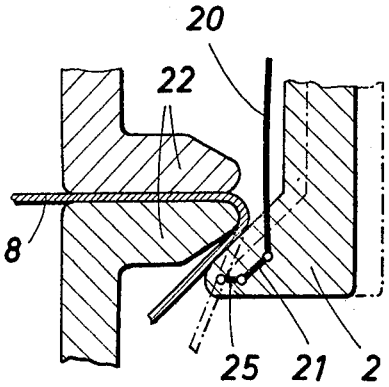
FIG. 4 illustrates the operation of the driven bending tool during the bending through angles in excess of 90°.

When the sheet metal element 8 is to be bent through angles in excess of 90°, an additional movement of the driven bending tool must be permitted in a direction which is transverse to the path 20. This is illustrated in FIG. 4. This additional movement may be imparted to the driven bending tool by moving crank arm 6 only by the adjusting lever 14, 16. For this purpose the shaft 15 is connected by a lever arm 23 to a fluid-operable adjusting actuator 24 which, when suitably supplied with pressure fluid, will impart a continued angular movement to the adjusting lever when the radial arm 10 has engaged the stop 12 to interrupt the movement imparted to the crank arm 5. When the crank arm 5 is held in position, the angular movement of the adjusting lever 14, 16 will result in a transverse movement of the driven bending tool along the path section 25 indicated in FIG. 4. With this arrangement, the angles of bend can be selected freely in a wide range.

Because the shaft 15 and the arm 23 will necessarily be rotated in unison with the angular movement imparted to the adjusting lever 14, 16 by the control lever 17, the adjusting actuator 24 must be able to follow that movement of the arm. For this reason the adjusting actuator 24 is not firmly pivoted to the frame 1 but is connected to the frame 1 by a fluid-operable backing actuator 26, which is connected in series with the adjusting actuator 24 and is non-displaceably connected to the latter. When the backing actuator 26 is free to discharge pressure fluid so that its piston is freely displaceable, the adjusting actuator 24 will be displaceable too. When the backing actuator 26 is blocked by closing its fluid conduits, the backing actuator 26 will provide a fixed backing for the adjusting actuator 24 so that the lever arm 23 and the shaft 15 can be angularly moved. The transitions between the path sections 20, 21 and 25 are defined by the engagement of the control lever 17 with the lever arm 16 of the adjusting lever 14, 16 and by the engagement of the radial arm 10 with the stop 12. For this reason the paths of the driven bending tools can be selected with a view to given conditions.

Adjusting lever 14, 16 can be held in position simply by blocking backing actuator 26. This can easily be effected by closing its fluid conduits. In case of an uncontrolled discharge of pressure fluid from the backing actuator 26 in response to an engagement of the control lever 17 with the coupling element 18 carried by the second lever arm 16, the driven bending tool may yield to the resilient restoring forces exerted by the partly bent marginal portion of the sheet metal element 8. Such yielding will be effectively prevented if the discharge of pressure fluid from the backing actuator 26 is controlled in dependence on the pressure applied to the actuator 19, which controls the coupling element 18. In that case the backing actuator 26 will not be released until the control lever 17 exerts a sufficiently strong force on the second lever arm 16 so that the latter can no longer move opposite to the sense in which it is actuated by the control lever 17.

By means of the control actuator 19, the coupling element 18 can be retracted from the path of the control lever 17 so that the path section 21 can be skipped. This will further increase the latitude regarding the shape to which the sheet metal elements 8 can be bent.

Figure 5:
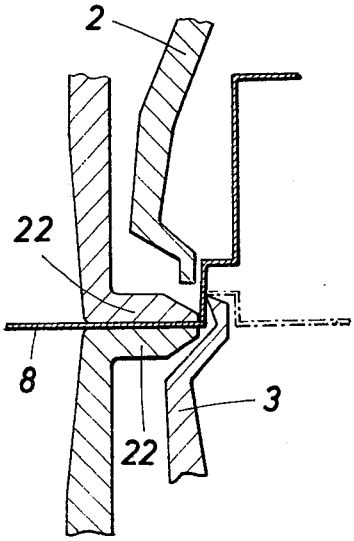
FIG. 5 illustrates a cooperation of two driven bending tools used to form grooves.
Figure 6:
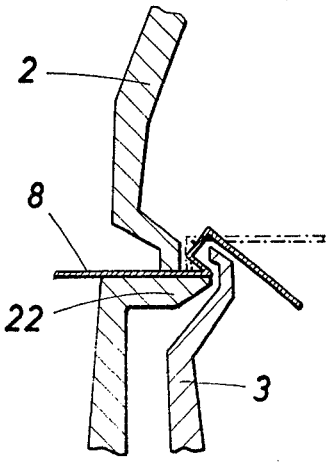
FIG. 6 illustrates the use of two driven bending tools for forming a reversely bent fold in a sheet metal element.

If the driven bending tools 2 and 3 cooperate not only with the jaws 22 for gripping the sheet metal elements to be bent but cooperate with each other to perform the bending operation, it will be possible to form grooves or reversely bent folds in the sheet metal element. This is shown in FIGS. 5 and 6. The driven bending tool 2 can be displaced substantially parallel to the plane of the sheet element 8, as shown in FIG. 5, so that the sheet metal element 8 is formed with a groove. In that operation the bending tool cooperating with the driven bending tool 2 is the driven bending tool 3 rather than the jaw 22.

In accordance with FIG. 6 the sheet metal element 8 is reversely bent on itself rather than about a second bending tool. This can be accomplished only when one of the two driven bending tools serves to hold the sheet metal element in position. This can readily be effected by means of the driven bending tools owing to their freedom of movement so that reversely bent folds can be formed too.

Driven crank arm 5 is pivoted to one part of a frame 1 on a first axis (pivot 11) and is also pivoted to one part of a link 7. Power-operable means are provided, which comprise a crank arm element pivoted at one end to another part of the link 7, and a second arm element having one end which is connected to and movable relative to another part of the frame 1, and another end which is connected to and movable relative to another end of said crank arm element. The second arm element consists of an adjusting lever arm 14, which is pivoted to said other end of said crank arm element on a second axis (pivot 13) spaced from the first axis (pivot 11).

What is claimed is:

1. In a press brake comprising a frame, a driven bending tool, a second tool adapted to cooperate with the driven bending tool for bending a sheet metal element, clamping means for holding the sheet metal element in fixed position relative to the tools, and a four-bar linkage for driving the driven bending tool, the improvement of the four-bar linkage comprising (a) two crank arms mounted on the frame, the crank arms each having respective first ends, (b) an adjustable pivot mounting one of the crank arms at an end opposite to the first end thereof on the frame, (c) a link connecting the first ends of the crank arms, the link carrying the driven bending tool, (d) an adjusting drive for adjusting the adjustable pivot of the one crank arm relative to the frame, the drive comprising a double-armed adjusting lever pivotally mounted on the frame, one arm of the adjusting lever carrying the adjustable pivot with said adjustable pivot linking the one adjusting lever arm to the opposite end of the one crank arm, and a control lever operatively connected to an end opposite to the first end of the other crank arm, the control lever cooperating with the other arm of the adjusting lever, and (e) means for driving the link carrying the driven bending tool by imparting a predetermined angular movement to the other crank arm and actuating the adjusting drive in response to said angular movement by the control lever which is operatively connected to the other crank arm and cooperates with the other adjusting lever arm.

2. In the press brake of claim 1, a stop for defining an end position for the angular movement of the other crank arm, the driving and actuating means being responsive to the end position of the other crank arm.

3. In the press brake of claim 1, the adjusting drive further comprising an actuator for adjusting the adjusting lever.

4. In the press brake of claim 3, the actuator being displaceable, and means for fixing the actuator in selected positions of displacement.

5. In the press brake of claim 4, the fixing means comprising a backing actuator connected in series with the adjusting actuator.

6. In the press brake of claim 1, a coupling element connecting the control lever and the other adjusting lever arm, the coupling element being adjustably mounted on one one of the levers.

7. In the press brake of claim 6, a control actuator connected to the coupling element.

8. In the press brake of claim 7, the adjusting drive further comprising a displaceable actuator for adjusting the adjusting lever, and a backing actuator connected in series with the adjusting actuator for fixing the adjusting actuator in selected positions of displacement, the backing actuator being actuatable in response to the actuation of the control actuator.

* * * * *